US005243890A

United States Patent [19]

Ober

[11] Patent Number: 5,243,890

[45] Date of Patent: Sep. 14, 1993

[54] CUTTER ASSEMBLY

[76] Inventor: Frank Ober, 7 Bournemount Rd., Islington, Ontario M9A 2C4, Canada

[21] Appl. No.: 970,779

[22] Filed: Nov. 3, 1992

[51] Int. Cl.[5] ..... B26D 1/18

[52] U.S. Cl. ..... 83/471.2; 83/478; 83/481; 83/487; 83/508; 83/582; 83/614

[58] Field of Search ..... 83/478, 481, 484, 485, 83/487, 508, 582, 614, 471.2

[56] References Cited

U.S. PATENT DOCUMENTS

| | | | |
|---|---|---|---|
| 442,823 | 12/1890 | Palm | 83/650 |
| 2,551,811 | 5/1951 | Mueller | 83/487 |
| 2,683,489 | 7/1954 | Jackman | 83/485 |
| 3,207,019 | 9/1965 | Vanzo et al. | 83/461 |
| 3,890,868 | 6/1975 | Pickler | 83/614 |
| 4,098,155 | 7/1978 | Insolio | 83/485 |
| 4,448,101 | 5/1984 | Templeton | 83/478 |

FOREIGN PATENT DOCUMENTS

| | | | |
|---|---|---|---|
| 564056 | 10/1932 | Fed. Rep. of Germany | 83/485 |
| 1144082 | 2/1963 | Fed. Rep. of Germany | 83/614 |

*Primary Examiner*—Hien H. Phan
*Attorney, Agent, or Firm*—Donald E. Hewson

[57] ABSTRACT

A cutter assembly for cutting sheets of relatively thin material is disclosed. The cutter assembly comprises a base member, a pair of support posts securely attached to the base member, and an elongated guide rail having a first end and a second end supported by the support posts in laterally spaced relation to the base member. A cutting strip is securely retained by the base member for receiving the sheets of material thereon. There is a cutter head slidably mounted on the elongated guide rail, and a cutting wheel operatively retained in rotatable relation by the cutter head. A spring biasing means biases the cutting wheel toward the cutting strip such that the cutting wheel is received in intimately contacting relation against the cutting strip. The cutting wheel moves along the elongated guide rail so as to intimately contact the cutting strip along the length thereof, so as to thereby permit cutting of the sheets of material when they are between the cutting wheel and the cutting strip. A spring member is disposed between upper and lower members of the base member so as to camber the upper member to match the bowing of the elongated guide rail that occurs as the cutting wheel moves along the elongated guide rail and therefore along cutting strip to cut the sheets of material.

21 Claims, 5 Drawing Sheets

CUTTER ASSEMBLY

FIELD OF THE INVENTION

This invention relates generally to the field of cutting devices and in particular to cutting devices which are appropriate for cutting thin sheet material such as paper, cloth, rubberized fabric synthetic fabrics and the like. In particular, this invention relates to a cutter assembly which is either manually or power operated.

BACKGROUND OF THE INVENTION

Various devices are known for cutting sheet material. For example, scissors are commonly used to cut paper and textile sheet material. However scissors are generally slow and labour intensive. Scissors are more appropriate for small cuts rather than repeated cuts of broad widths of material as may be required for packaging or other applications. A further type of cutting device for elongate sheet material is a guillotine in which a pivoted shearing arm is brought past a cutting edge and a long straight cut through the sheet material is made with one motion. However, again, these applications are generally restricted precise cuts made in smaller sheet material and are not appropriate for larger applications.

What is required is a cutter which is capable of cleanly and efficiently cutting sheet material of any width and which is capable of cutting all different kinds of sheet material including plastics, synthetic fabrics, natural fabrics, papers, and rubberized materials. Such a cutter would preferably cut consistent straight lines and would cut such lines with a minimum of motion and a maximum of speed. Such a cutter would preferably be one which could be manually operated or optionally power operated.

BRIEF SUMMARY OF THE INVENTION

A cutter assembly for cutting at least one relatively thin sheet of material is disclosed. The cutter assembly comprises a base member, a support means securely attached to the base member, and an elongated guide rail having a first end and a second end. The elongated guide rail is supported by the support means in laterally spaced relation to the base member. A cutting strip is securely retained by the base member for receiving the at least one sheet of material thereon. There is a cutter head slidably mounted on the elongated guide rail, and a cutting means operatively retained by the cutter head. A biasing means biases the cutting means toward the cutting strip such that the cutting means is received in intimately contacting relation against the cutting strip. The cutting means moves along the elongated guide rail so as to intimately contact the cutting strip along the length thereof, so as to thereby provide means to cut the at least one sheet of material when the at least one sheet of material is between the cutting means and the cutting strip.

BRIEF DESCRIPTION OF THE DRAWINGS

Reference will now be made to the accompanying drawings which illustrate preferred embodiments of the invention, by way of example only, and in which.

DETAILED DESCRIPTION OF THE PREFERRED EMBODIMENTS

Figures 1, 1A, 2:
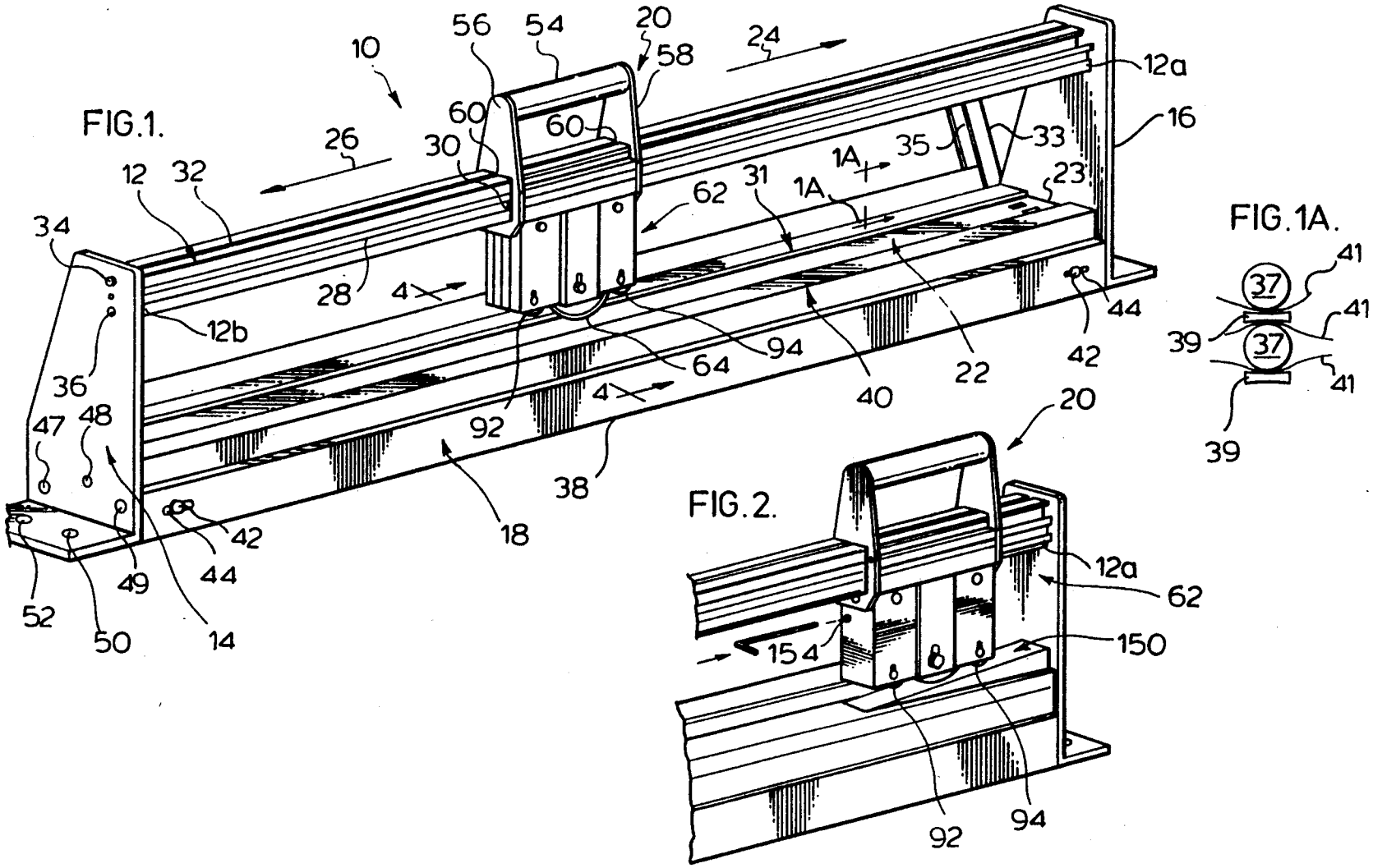
FIG. 1 illustrates a cutter assembly according to the present invention.
FIG. 1A illustrates a feature of the cutter assembly of FIG. 1 along section line 1A—1A.
FIG. 2 illustrate the cutter assembly of FIG. 1 in a knife changing position.

A cutter assembly is shown generally as 10 in FIG. 1. The cutter assembly 10 includes an elongated guide rail 12, support means in the form of first and second support posts 14 and 16 and a base member generally indicated at 18. The elongated guide rail 12 has first and second ends **12*a* and 12*b* and is supported by the first and second support posts 14 and 16. Also shown are a cutter head 20 and a cutting strip 22. The base member 18, the cutting strip 22 and the elongated guide rail 12** are substantially straight.

The elongated guide rail 12 is preferably formed with a profile which can allow the easy lateral movement of the cutter assembly 20, which is slidably mounted on the elongated guide rail 12, as indicated by arrows 24 and 26. To accomplish this, the elongated guide rail may have a profile which includes a groove 28 within which a nylon bushing 30 located in the cutter head 20 may glide. Additional grooves may be formed in the top and the bottom, for example at 32, to form passageways into which end screw 34 and 36 may be secured. Good results have been achieved when the elongated guide rail 28 is composed of extruded aluminum, namely, 6063-T5 alloy supplied by Indalex, A Division of Indal of Toronto, Canada.

Turning now to the base member 18, the base member 18 is preferably formed from a lower member 38 and an upper member 40. The lower member 38 is an upwardly facing channel and the upper member 40 is a downwardly facing channel engaged within the lower member 38 so as to define a generally hollow interior 43 therebetween. The lower member 38 is secured to upper member 40 by means of screws 42 which are located at opposite sides on either end of the lower member 38. Screws 42 are preferably inserted through an opening 44 formed in the lower member 38 which allows for a limited amount of movement as described hereafter.

The first and second support posts 14 and 16 are preferably formed from steel. In additional to the screws 36 and 34 for securing the elongated guide rail 12, there are screws 47, 48 and 49 at either end for securing the first and second support posts 14 and 16 to the upper member 40. Preferably, the upper member 40 will also be formed from extruded aluminum and will include substantially circularly shaped grooves 45 (shown in end detail in FIG. 4) to accommodate the screws 47, 48 and 49 at either end of the assembly. Also shown is an anchor plate 50 with openings 52 which may be used to secure the cutter assembly 10 to a bench, table or the like. The anchor plate 50 may be made integral with first and second support posts 14 and 16, or may be formed after and secured onto the first and second support posts 14, 16 by welding or the like.

Figure 4:
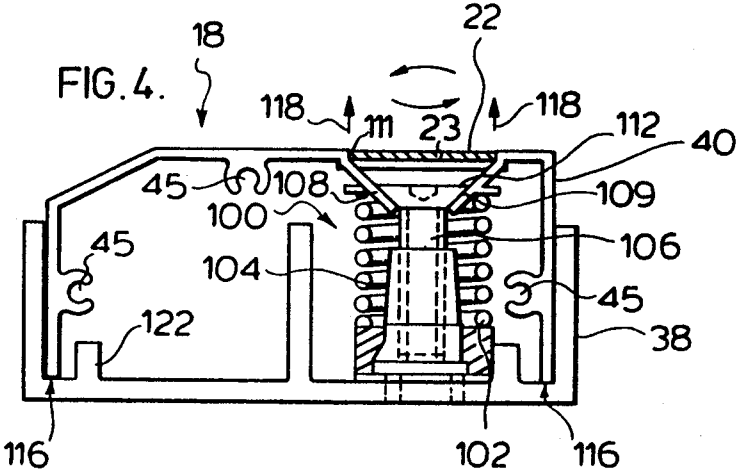
FIG. 4 is a cross-sectional view along the lines of 4—4 of FIG. 1.

The upper member 40 will also preferably include a cutting strip 22 carrying channel 23 (shown in FIG. 4). The carrying channel 23 provides means for the base member 18 to securely retain the cutting strip 22 in place below the elongated guide rail 12. The cutting strip 22 is preferably formed from tempered spring steel BTS-1095. The preferred hardness is within the range of 50 to 65 on the Rockwell C. Harness scale, with a most preferred hardness of 50 to 51.

Also shown is FIG. 1 is a feed means indicated generally as 31 and including end posts 33 at either end. The end posts 33 are formed with channels 35 into which fit separator bars 37. The separator bars 37 (one of which is shown in FIG. 1) are preferably in the form of round bars, alternating with double concave intermediate members 39 (see FIG. 1A). It will be appreciated that various types of sheet material may need to be cut with the same cutting apparatus. By having the feed means 31, various sheet material 41 can be advanced by hand through the feed means 31 to be cut individually, or layered as appropriate.

The cutter head 20 is comprised of a number of different components. As shown in FIG. 1 there is a handle 54 located between two handle supports 56 and 58. The handle supports 56 and 58 have openings 60 formed in them which openings are designed to allow the elongated guide rail 12 to pass therethrough. Located below the elongated guide rail is a housing 62, which is part of the cutter head 20, and which operatively retains a cutting means, which is in the form of a cutting wheel or knife 64 mounted in rotatable relation on the cutter head 20. The cutting wheel 64 is received in intimately contacting relation against the cutting strip 22 and moves along the elongated guide rail 12 so as to intimately contact the cutting strip 22 along the length thereof, as will be explained in greater detail subsequently. In this manner, means to cut sheets of material is provided.

Figure 3:
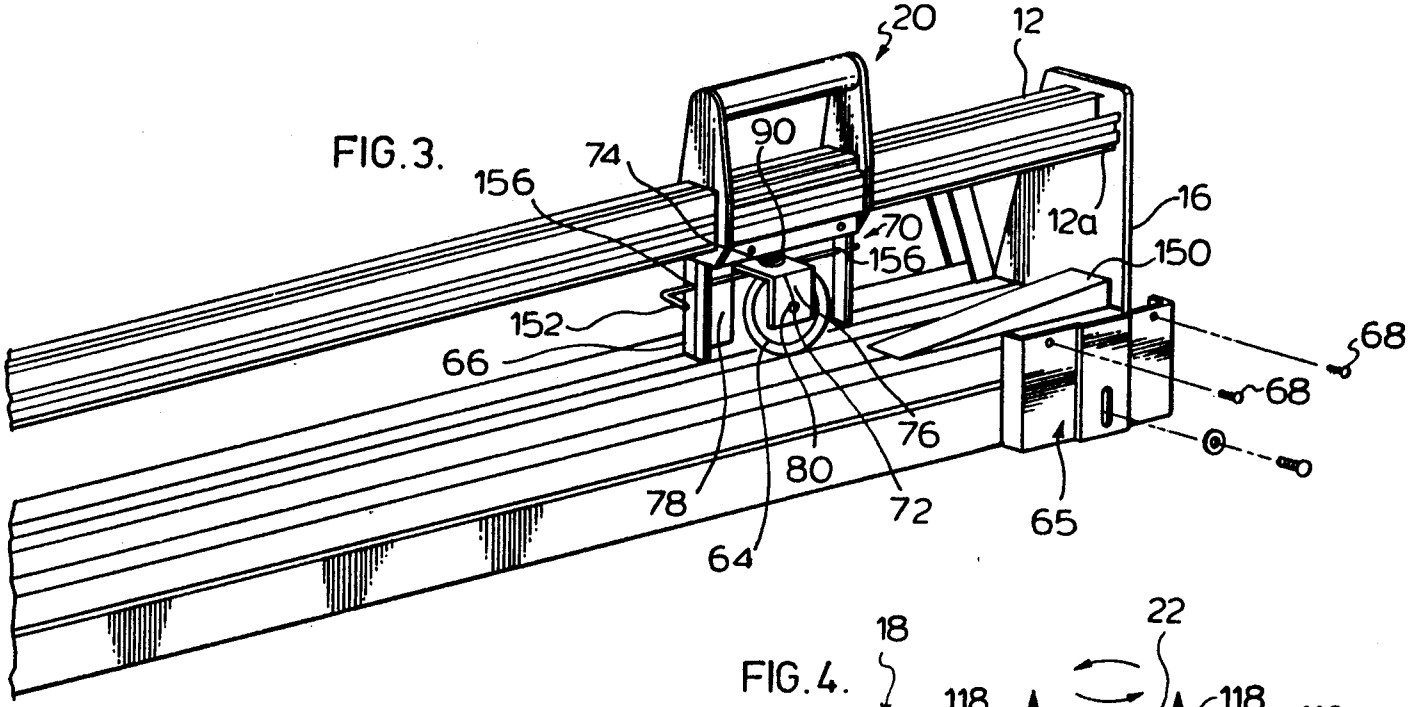
FIG. 3 is an exploded view of FIG. 2.

The details of the housing 62 are more fully illustrated in FIGS. 2 and 3. In FIG. 3, the housing 62 is shown in exploded view. The housing 62 is comprised of a first housing component 65 and a second housing component 66. The component 65 is attached by means of screws 68 into a base member 70. The component 66 is similarly attached on the opposite side. The cutting wheel 64 is preferably retained in a yoke 72 which includes a top member 74 and a side member 76. A complimentary side member 78 is formed on the opposite side of the yoke. An axle 80 extends between the side members 76 and 78. The axle 80 is rotatably housed in side members 76 and 78 to allow cutting wheel 64 to rotate. The axle 80 extends beyond the side members 76 and 78 and through opposed vertically displaced slots 79 in the housing 62. The vertically displaced slots allow for vertical travel of the cutting wheel 64 as it travels along the cutting strip 22.

Also shown in FIG. 3 is a biasing means 90 which is in the form of a spring. It has been found that a Honda valve lifter spring of 1 inch or 15/16th" inch diameter (Honda Part No. 18230-SA0-930) is appropriate. The purpose of this spring is to bias the cutting wheel 64 toward the cutting strip 22.

Turning to FIG. 2, like numerals are used to designate like components as in FIGS. 1 and 3. Additionally however, there are shown finger protectors 92 and 94 extending downwardly from the housing 62, which are intended to prevent an operator's fingers from being trapped in the path of the cutting wheel 64. These protectors 92, 94 are a desirable, but optional, safety feature.

Turning to FIG. 4, the upper member 40 is shown in place in the lower member 38 with the cambering means 100 located generally centrally along the base member 18. The cambering means 100 comprises a spring member 102, a threaded sleeve 104, a screw 106 and a collar 108. The screw 106 is threadably engaged, in the threaded sleeve 104, and has a filleted head shown at 112, which fits against the sloped shoulders 109 of the collar 108, with the screw 106 freely rotatably engaged within the collar 108. The collar 108 is formed in the upper member 40, and defines an aperture 111 that is adapted to receive the screw 106 therethrough.

The purpose of the cambering means 100 is as follows. In order to cut a sheet of material the cutter head 20 is moved along the elongated guide rail 12 which in turn causes the cutting wheel 64 to roll along the cutting strip 22. Any sheets of material between the cutting wheel 64 and the cutting strip 22 are of course cut. The downward force for cutting is provided by the spring 90 in the cutter head 20. The downward force of the cutting wheel 64 on each end of the cutting strip 22 is predictable and constant at both ends because the displacement of the spring 90 is known and the distance from the elongated guide rail 12 to the cutting strip 22 is set. The spring 64 can be chosen to give a specific downward force at the ends **12*a* and 12*b* of the elongated guide rail 12. However, as the cutter head 20 is moved along the elongated guide rail 12, the elongated guide rail 12 can become bowed upwardly by the oppositely directly resultant force of the spring member on the elongated guide rail 12. This bowing causes a reduction in the amount of downward force from the cutting wheel 64 on the cutting strip 22, which is undesirable because it makes some materials harder to cut. In order to compensate for the bowing of the elongated guide member 12, the upper member 40 of the base member 18 is cambered upwardly to substantially match the shape of the elongated guide member 12 bows to, thus allowing the downward force of the cutting wheel 69 or the cutting strip 22** to remain relatively constant as it moves therealong.

It can now be appreciated how the cambering means 100 functions. Firstly, the spring member 102 is placed over the threaded sleeve 104. The upper member 40 is laid into the lower member 38 with the bottom portion of the collar 108 being received within the spring member 102. The spring member 102 is thereby disposed between the lower member 38 and the upper member 40 so as to spring bias the upper member 40 with respect to the lower member 38. The ends of upper member 40 contact the lower member 38 at points 116 shown at FIG. 4. The central portion of the upper member 40 is movably cambered by the spring member 102. The upper member 40 can still move toward the lower member 38 when downward pressure is applied to the upper member 40. By this means, a flexible camber is realized.

The screw 106 is then inserted through the aperture 111 and threadably engaged into the threaded sleeve 104. The screw 106 is rotated, preferably by use of an Allan Key 114, to compress the spring member 102 and thereby lower the upper member 40 towards the lower member 38.

Figure 5:
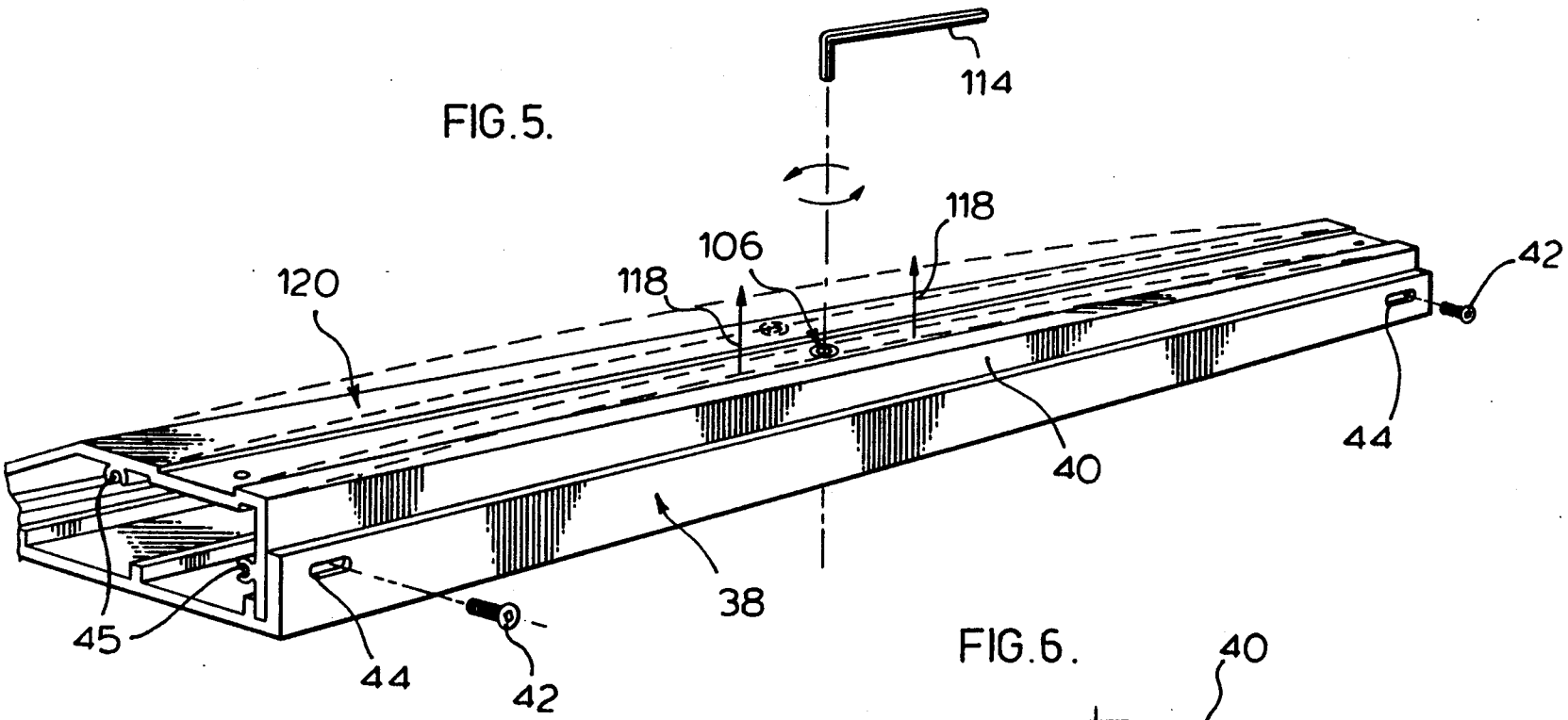
FIG. 5 is a view in partial section illustrating a further feature of the present invention.

At this point, the screws 42 shown at FIG. 5 are inserted into the slots 44 and screwed into the upper member 40. The screws 42 are located at all four corners of the assembly so that the upper channel is firmly secured at the ends within the lower member 38.

Once the ends of the upper member 40 have been secured to the lower member 38, the spring member 102 is trying to camber the upper member 40 with respect to the lower member 38. The filleted head 112 of the spring member 102 acts as a stop means to limit the amount of camber of the upper member 40 with respect to the lower member 38, so as to allow the screw 106 to act as a camber limiting means to limit the amount of camber in the upper member 40. To get the upper channel 40 in a properly cambered position with respect to the lower member 38, it is necessary to again rotate the screw 106 in the opposite direction in the threaded sleeve 104 by means of the Allan key 114. The spring member 102 forces the upper member 40 upwardly, as shown by arrows 118, into a cambered position with respect to the lower member 78 as the screw 106 is turned in the appropriate direction. The upper member 40 will ultimately assume the profile shown in dotted outline in FIG. 5 as 120.

Figure 6:
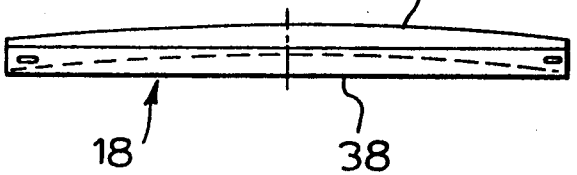
FIG. 6 is a side view of FIG. 5.

Turning to FIG. 6, in side view, it can be seen in the upper member 40 is bowed upwardly with respect to the lower member 38. It will now be appreciated that the slots 44 allow lateral movement of the screws 42 which are secured to the upper member 40 through the slots 44 in the lower member 38. The slots 44 provide the screws with a limited amount of play to allow the upper member 40 to be bowed as outlined above.

It will be appreciated that as the upper member 40 is urged upwardly into a bowed configuration, an equal amount of force will be exerted downwardly to bow lower member 38 outwardly. This is undesirable as is could lower the stability of the cutting apparatus. Thus, in order to prevent this from occurring lower member 38 is formed with a series of reinforcing ribs 122. These ribs are shown in FIG. 4 and a although adequate results have been achieved with the configuration shown in FIG. 4 better results could be achieved by lengthening the ribs 122 to increase the stiffness of the lower member 38. Additionally, the anchor plates 50 can be used to secure the assembly directly to a table top or the like which will further reduce the downward deflection or the channel 38.

Figure 7:
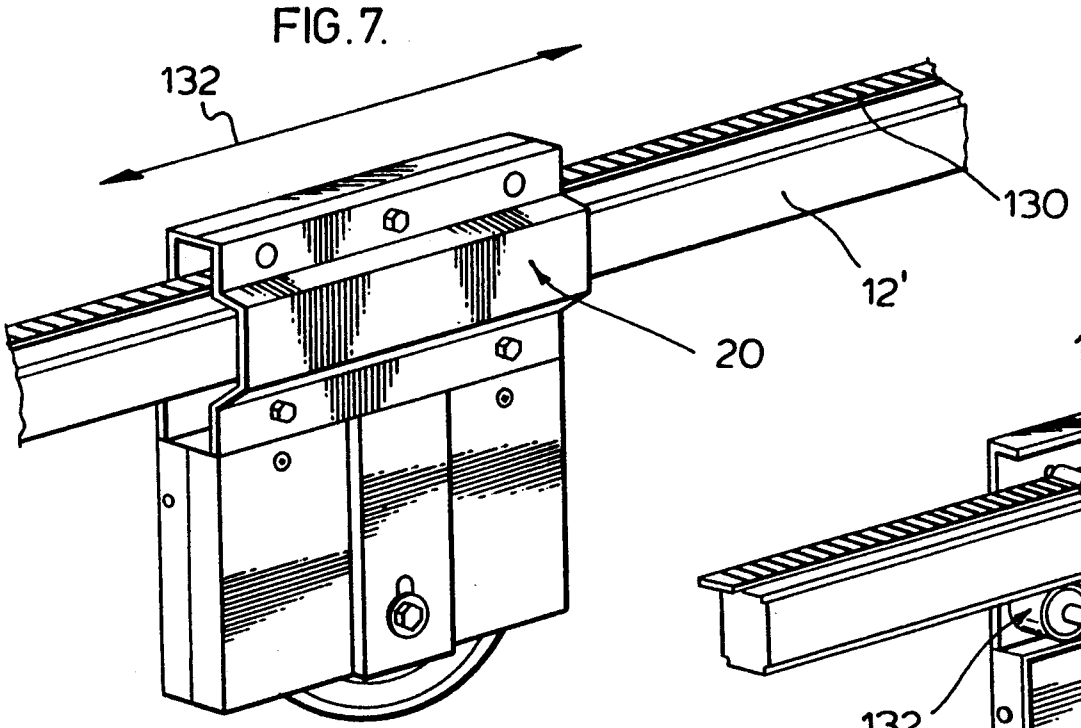
FIG. 7 is a view of a cutter head assembly according to a second aspect of the present invention.

Turning now to FIG. 7, a further embodiment of the instant invention is shown. In this embodiment, the overhead rail is indicated by 12' and has a different cross-sectional profile than the elongated guide rail 12 of the first embodiment. This embodiment may be referred to as the motorized head embodiment and includes a power chain 130 which would be driven by a conventional motor which will be known to those skilled in the art and thus is not discussed in anymore detail herein. The power chain 130 may be in the form of a chain, a belt, or other flexible linking element and will allow the cutter head 20 to be moved back and forth in the direction of double-ended arrow 132.

Figure 8:
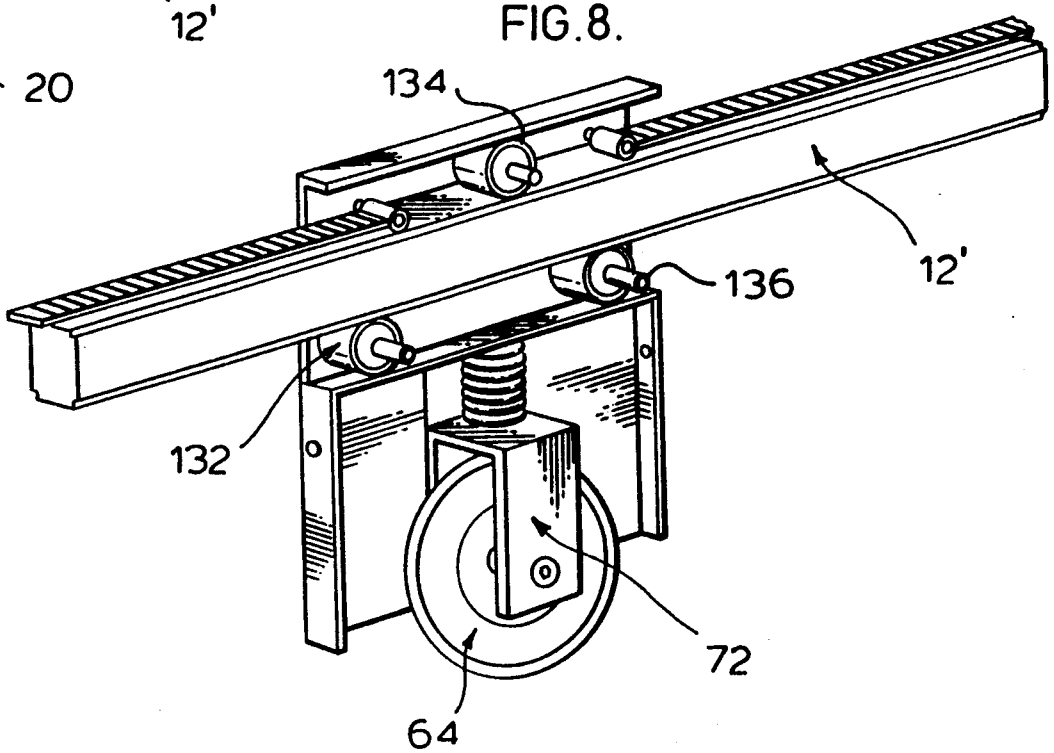
FIG. 8 is a break away view of the components of FIG. 7.

Turning to FIG. 8, the alternative embodiment of FIG. 7 is shown with component 65. As can be seen, there are provided three thrust bearings, 132, 134 and 136 two of which act underneath the elongated guide rail 12' and one of which acts above the elongated guide rail 12'. The cutting wheel 64 is identical to that described in the previous embodiment, and includes an identical yoke 72.

Figure 9:
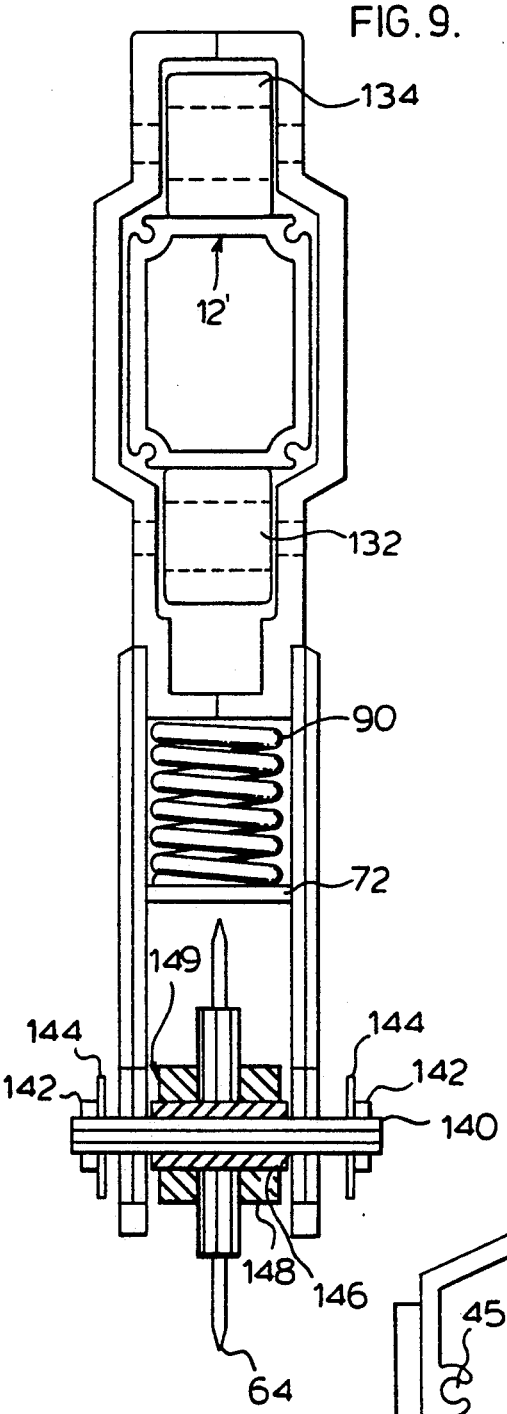
FIG. 9 is a cross sectional view, in part section, of the components of FIG. 8.

FIG. 9 shows a cross-sectional view through the embodiment of FIGS. 7 and 8 in part section through the cutting wheel. Beginning at the bottom of the Picture there is shown an axle 140 which has nuts 142 on either side and washers 144. The cutting wheel 64 is secured onto an oil impregnated bronze bushing 146 which in turn has brass spacing rings 148 on either side. The edges of brass spacing rings 148 are machined away at for example 149 to ensure that the oil impregnated bronze bushing makes contact with the sides of the yoke 70. By means of close tolerances, the cutting wheel 64 is assured of a smooth consistent line of travel as the cutting head is moved across elongated guide rail 12''.

The operation of the instant invention can now be understood. In cutting different materials, different forces are appropriate between the cutting wheel 64 and the cutting strip 22. However, it has been found that good results are achieved across a wide range of materials when the cutting pressure is generally between 55 and 80 pounds, preferably 65 pounds. Upon this amount of cutting pressure however the elongated guide rail 12 will tend to bow upwardly across its span. Resultingly, if the upper member 40 of the base member 18 is not cambered, the spring 90 will expand and the force of the cutting wheel 64 on the cutting strip will be somewhat reduced. Thus, in this situation, in order to achieve the desired pressure at the centre of the span is may be necessary to over pressure the cutting wheel at the edges of the span since deflection will not occur closely adjacent to the steel plate lateral supports 14, 16. Over pressuring at the ends will result in premature wear and dulling of the cutting wheel and necessitate rapid and frequent replacement which is undesirable and expensive.

However, by rotating the screw 106, the upper member 40 of the base member 18 can be cambered upwardly by the force of the spring member 102 to assume the profile of the deflection of the elongated guide rail 12 under the influence of the spring 90. As the cutter head 20 is slid along the elongated guide rail 12, the cutting wheel 64 moves along the cutting strip 22 in intimately contacting relationship thereto so as to cut any sheet material thereon. As the cutting wheel 64 moves along the cutting strip 22, the downward force from the spring 90 and from the bowing of the elongated guide member 12 cause the spring member 106 to be compressed slightly. In this manner, the action of the cambering remains smooth along the length of the cutting strip 22, which translates to a relatively constant force required to move the cutter head 20 along the elongated guide rail 12. This will enable the deflection of the spring 90 to remain substantially constant across the entire cutter assembly, which in turn will allow the cutting force to be constant. Thus, premature wear of the cutting wheel can be avoided and consistency of cutting can be achieved.

If the cambering means is rigid instead of being a spring member, the upper member 40 would deflect sightly between its secured ends and the cambering means, and would not deflect at the cambering means. Resultingly, a greater pressure would be applied by the cutting wheel 64 on the cutting strip 22 due to the downward force of the spring 90, which in turn would translate to an uneven force required to move the cutter head 20 along the elongated guide rail 12.

Turning to FIG. 2, a further advantage of the instant invention can be identified. When the assembly 10 is initially assembled, one end of the elongated guide rail 12 will be attached loosely to one end support 14 for example. Then, the cutter head 20 will be slid onto the free end. The spring will be inserted into the cutter head housing 62, and the yoke including a cutting wheel 64 will be inserted underneath it. Then, the cutter head 20 can be moved to the pinned end of the cutting assembly and positioned above the cutting strip 22. Then, the free end of rail 12 can be lowered and securely attached to the opposite end support 16. By reason of the length of the lever arm which comprises the whole elongated guide rail 12, this is a relatively simply operation. Thereafter, the cutter head 20 can be run back and forth causing the cutting wheel 64 to roll over the cutting strip 22 and cutting any material that is placed there between.

However, FIG. 2 shows how a cutting wheel 64 may be easily changed in the event that it becomes dull and needs replacement. First, the cutter head 20 is moved towards one end such as lateral support 14. A wedge 150, which acts as an upwardly inclined plane, is placed at the end which causes the cutting wheel to ride up to a withdrawn position, which deforms the spring 90 by way of further compressing it. A locking bar 152 can then be inserted through holes 154 and 156 in the housing. These position the locking bar underneath the yoke 70 so that when the cutter head 20 is moved off of the wedge 150, the locking bar maintains the spring 90 in compression. Thereafter the cutting wheel 64 can be removed from the yoke and a fresh sharp cutting wheel 64 easily inserted.

Figure 10:
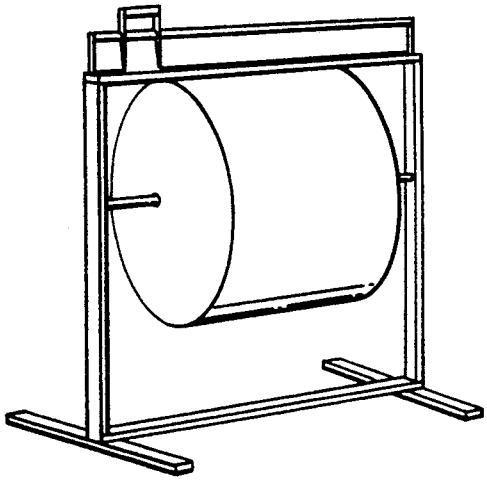
FIG. 10 is a view of a cutter assembly mounted into a mobile stand.

A further feature of the present invention, is that it may be incorporated into a mobile stand, for example, for hospital use. In some instances hospitals are now using disposable sheet material for certain applications, such as beneath a patent during an operation. This sheet material must be cut in such a manner that the edges are not frayed. Such cuts can be achieved by the instant invention. To facilitate the use of the cutter, say at the end of an operating table, the cutter can be mounted into a stand which also includes the sheet material in a large roll such as shown in FIG. 10.

Figure 11:
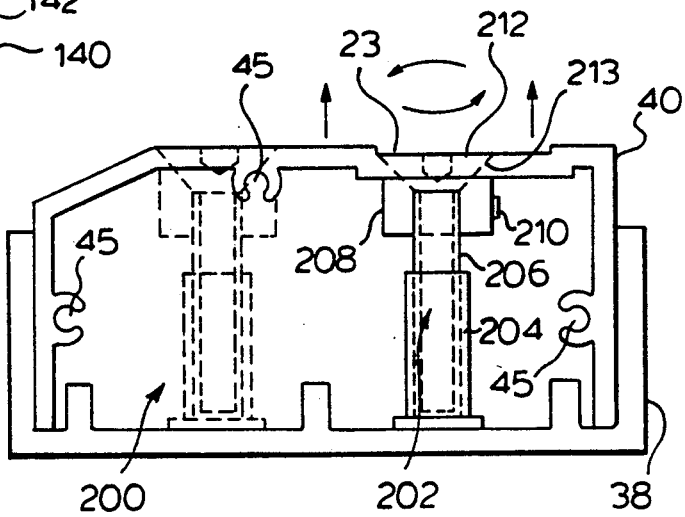
FIG. 11 is a cross-sectional view, similar to FIG. 4, but of an alternative embodiment.

In a further alternative embodiment, as shown in FIGS. 11 and 12, a cambering means 202 is comprised of a threaded sleeve 204 extending upwardly from the bottom member 238, a screw 206 and a collar 208. The collar 208 includes a locking screw 210. The screw 206 has a filleted head shown at 212. The filleted head 212 fits into an appropriately filleted hole 213 formed in the upper member 240. As the screw 206 is turned, the upper member 240 is moved with respect to the lower member 238. Also shown is cambering means 200 in dotted outline. The presence of two cambering means may be required in certain applications.

In a further alternative embodiment, it is contemplated that the base member, the cutting strip and the elongated guide rail are curved.

It will be appreciated that the foregoing description relates to preferred embodiments of the instant invention and that various modifications may be made which still fall within the broad scope of the appended claims. For example, other shapes of extruded aluminum channels and other materials may provide good results. Also while the cambering means 102 may be generally centrally located, depending upon the span of the cutting apparatus 10, two such cambering means may be located each one third of the way across the span of the apparatus 10. However, the foregoing description is intended to be by way of example only and the exclusive property or privilege is defined in the appended claims.

What is claimed is:

1. A cutter assembly for cutting at least one relatively thin sheet of material, said cutter assembly comprising:

a base member including an upper member, a lower member, and a cambering means connected to said upper and lower members for cambering said upper member upwardly, said cambering means including a spring member disposed between said lower member and said upper member so as to spring bias said upper member with respect to said lower member such that said upper member can move towards said lower member as said cutter wheel moves along said cutting strip;

support means securely attached to said base member;

an elongated guide rail having a first end and a second end, and being supported by said support means in laterally spaced relation to said base member;

a cutting strip securely retained by said base member for receiving said at least one sheet of material thereon;

a cutter head slidably mounted on said elongated guide rail, a cutting wheel operatively retained in rotatable relation by said cutter head, a biasing means that biases said cutting means toward said cutting strip;

whereby said cutting wheel is received in intimately contacting relation against said cutting strip; and wherein said cutting wheel moves along said elongated guide rail so as to intimately contact said cutting strip along the length thereof, so as to thereby provide means to cut said at least one sheet of material when said at least one sheet of material is between said cutting wheel and said cutting strip.

2. The cutter assembly of claim 1, further comprising a camber limiting means for adjustably limiting the amount of camber of said upper member.

3. The cutter assembly of claim 2, wherein said camber limiting means is a screw threadably engaged in one of said upper and lower members and freely rotatably engaged in the other of said upper and lower members, with a portion of said screw acting as a stop means to limit the amount of camber of said upper member with respect to said lower member.

4. The cutter assembly of claim 3, wherein said support means comprises first and second support posts located at said first and second ends respectively of said elongated guide rail.

5. The cutter assembly of claim 4, wherein said cambering means is located generally centrally along said base member.

6. The cutter assembly of claim 4, having two cambering means each of which is located one-third of the way between said lateral supports.

7. The cutter assembly of claim 4, wherein said lower member is an upwardly facing channel and said upper member is a downwardly facing channel engaged within said upwardly facing channel so as to define a generally hollow interior therebetween.

8. The cutter assembly of claim 7, wherein said lower member includes reinforcing ribs to inhibit bowing of said lower member.

9. The cutter assembly of claim 1, wherein said cambering means further comprises a threaded member disposed between said lower member and said upper member and threadably engaged in one of said upper and lower members and freely rotatably engaged in longitudinally secured relation in the other of said upper and lower members.

10. The cutter assembly of claim 1, wherein said housing includes nylon bushings to reduce the sliding friction between said cutter head and said overhead rail.

11. The cutter assembly of claim 1, wherein said housing includes thrust bearings to reduce sliding friction between said cutter head and said overhead rail.

12. The cutter assembly of claim 1, wherein said biasing means may be deformed to allow said cutting wheel to be replaced.

13. The cutter assembly of claim 12, wherein said biasing means may be further deformed to a withdrawn position and retained in said withdrawn position by a locking bar to facilitate the replacement of said cutting wheel.

14. The cutter assembly of claim 13, wherein said biasing means is deformed to said withdrawn position by forcing said cutter head over an upwardly inclined plane.

15. The cutter assembly of claim 1, further comprising feed means for facilitating the feeding sheet material to be cut into said cutter assembly.

16. The cutter assembly of claim 15, wherein said feed means comprises a pair of opposed channeled end posts housing alternating separator bars and intermediate members.

17. The cutter assembly of claim 1, wherein said housing further includes finger protectors extending downwardly from said cutter head in front of and behind said cutting wheel.

18. The cutter assembly of claim 1, further including a motor and a drive chain for driving said cutter head back and forth along said elongated guide rail.

19. The cutter assembly of claim 1, further including a mobile stand adapted to hold a roll of sheet material to be cut.

20. The cutter assembly of claim 1, wherein said base member, said cutting strip, and said elongated guide rail are substantially straight.

21. The cutter assembly of claim 1, wherein said base member, said cutting strip, and said elongated guide rail are curved.

* * * * *